US011605928B2

(12) United States Patent
Glockseisen

(10) Patent No.: US 11,605,928 B2
(45) Date of Patent: Mar. 14, 2023

(54) MANUAL PLIERS TOOL

(71) Applicant: WEZAG GmbH Werkzeugfabrik, Stadtallendorf (DE)

(72) Inventor: Thomas Glockseisen, Duesseldorf (DE)

(73) Assignee: WEZAG GmbH & Co. KG, Stadtallendorf (DE)

( * ) Notice: Subject to any disclaimer, the term of this patent is extended or adjusted under 35 U.S.C. 154(b) by 967 days.

(21) Appl. No.: 16/417,721

(22) Filed: May 21, 2019

(65) Prior Publication Data

US 2019/0363502 A1 Nov. 28, 2019

(30) Foreign Application Priority Data

May 23, 2018 (EP) ..... 18173803

(51) Int. Cl.
*H01R 43/048* (2006.01)
*B25B 7/12* (2006.01)
*H01R 43/042* (2006.01)

(52) U.S. Cl.
CPC ..... *H01R 43/0486* (2013.01); *B25B 7/12* (2013.01); *H01R 43/042* (2013.01)

(58) Field of Classification Search
CPC ..... B25B 7/12; H01R 43/042; H01R 43/0486
See application file for complete search history.

(56) References Cited

U.S. PATENT DOCUMENTS 5,153,984 A 10/1992 Beetz et al.
5,913,933 A 6/1999 Beetz et al.
6,026,671 A 2/2000 Battenfeld
7,318,631 B2 1/2008 Kreyenkamp
7,793,751 B2 9/2010 Stevens
8,245,560 B2 8/2012 Battenfeld et al.
8,613,210 B2 12/2013 Wagner et al.
8,911,035 B2 12/2014 Kopnick et al.
9,277,812 B2 3/2016 Bennett et al.
(Continued)

FOREIGN PATENT DOCUMENTS

CA 1115035 A 12/1981
CN 101400482 4/2011
(Continued)

OTHER PUBLICATIONS

Product catalogue of the WEZAG GmbH Werkzeugfabrik, publication No. 10/11: "Tools for professional application", Nov. 1, 2011.
(Continued)

*Primary Examiner* — Carl J Arbes
(74) *Attorney, Agent, or Firm* — The Sladkus Law Group

(57) ABSTRACT

The invention relates to a manually operated pliers tool, which may especially be crimping pliers. According to the invention, the pliers tool is equipped with an electronics construction unit. The electronics construction unit is realized separately from a mechanical pliers part and arranged in a pliers head part of the mechanical pliers part, which is arranged between hand levers and pliers jaws. The electronics construction unit is attached to this pliers head part. The electronics construction unit extends at least on two opposite sides of the pliers head part, sandwiching the pliers head part, and comprises a connector, where the connector extends through or around the pliers head part between the two opposite sides of the pliers head part.

17 Claims, 9 Drawing Sheets

(56) References Cited

U.S. PATENT DOCUMENTS

| | | | | |
|---|---|---|---|---|
| 9,864,948 | B2 | 1/2018 | Glockseisen | |
| 9,908,221 | B1 | 3/2018 | Czaplewski | |
| 10,427,201 | B2 | 10/2019 | Bungter et al. | |
| 2006/0011022 | A1 | 1/2006 | Fairburn | |
| 2010/0293720 | A1* | 11/2010 | Zhang | B25B 27/10 7/125 |
| 2011/0235312 | A1 | 9/2011 | Houser et al. | |
| 2013/0233043 | A1 | 9/2013 | Kelly | |
| 2017/0165813 | A1 | 6/2017 | Wang | |
| 2017/0239788 | A1 | 8/2017 | Battenfeld | |
| 2018/0115132 | A1 | 4/2018 | Glockseisen et al. | |

FOREIGN PATENT DOCUMENTS

| | | | |
|---|---|---|---|
| CN | 203 804 813 | U | 9/2014 |
| DE | 40 23 337 | C1 | 10/1991 |
| DE | 40 26 332 | C2 | 7/1992 |
| DE | 197 13 580 | C2 | 12/1999 |
| DE | 198 07 737 | C2 | 6/2000 |
| DE | 197 53 436 | C2 | 10/2002 |
| DE | 203 17 913 | U1 | 3/2004 |
| DE | 20 2004 011 200 | U1 | 1/2006 |
| DE | 10 2005 003 615 | B3 | 9/2006 |
| DE | 10 2006 055 806 | A1 | 5/2008 |
| DE | 20 2008 003 703 | U1 | 6/2008 |
| DE | 10 2008 005 472 | B3 | 2/2009 |
| DE | 11 2011 102 299 | T5 | 7/2013 |
| DE | 10 2013 203 553 | B3 | 7/2014 |
| DE | 20 2015 102 233 | U1 | 9/2016 |
| DE | 20 2014 011 110 | U1 | 1/2018 |
| EP | 0 471 977 | B1 | 7/1991 |
| EP | 1 925 238 | B1 | 8/2009 |
| EP | 2 1313 235 | B1 | 5/2010 |
| EP | 2 353 436 | B1 | 11/2012 |
| EP | 2 995 424 | A1 | 9/2014 |
| EP | 3 208 044 | A1 | 2/2016 |
| EP | 3 090 654 | B1 | 4/2016 |
| EP | 3 312 949 | A1 | 10/2016 |
| WO | 2011/080466 | A1 | 7/2011 |

OTHER PUBLICATIONS

Publication "Crimptechnik, Herstellung prozesssicherer Verbindungen von elektrischen Leitem und Steckern" of the WEZAG GmbH Werkzeugfabrik company, Die Bibliothek der Technik 342, Verlag Moderne Industrie, ISBN 978-3-68236-027-7, dated Oct. 10, 2011.

Four-mandrel crimping pliers designated as "MicroCrimp" as offered for sale on the web page www.rennsteig.com; retrieved from website link: https://www.rennsteig.com/en/products/crimping-4-8-indent/808-4-8-indent-crimping-tool-microcrimp-for-industrial-contacts on May 9, 2019.

Four-mandrel crimping pliers designated as "DigiCrimp" as offered for sale on the web page www.rennsteig.com; retrieved from website link: https://www.rennsteig.com/en/products/crimping-4-8-indent/810-4-8-indent-crimping-tool-digicrimp-for-mil-sae-contacts on May 8, 2019.

European Patent Application No. EP 18166739.5, filed Apr. 11, 2018 entitled Zangenschwenkbacke in Plattenbauweise und Crimpzange mit einer Zangenschwenkbacke.

International Preliminary Report on Patentability in co-pending related PCT Application No. PCT/EP2017/080758, dated Jun. 4, 2019.

European Search Report in co-pending, related EP Application No. 019154272.9, dated Oct. 8, 2019.

* cited by examiner

MANUAL PLIERS TOOL

CROSS REFERENCE TO RELATED APPLICATIONS

This application claims priority to co-pending European Patent Application No. EP 18 173 803.0 filed May 23, 2018.

FIELD OF THE INVENTION

The invention relates to a manual pliers tool in which the pliers force is at least partially and preferably completely generated by a hand force. The pliers tool can especially be crimping pliers. By means of pliers, via manual operation of hand levers a workpiece can be pressed or crimped. In this, crimping pliers especially serve for generating a permanent mechanical connection and electrical contracting. This is achieved preferably by crimping a plug to a cable or an electrical conductor realized in any way. Depending on the profile of the die employed, different crimping processes can be executed with the crimping pliers. For example, the crimp may be a closed crimp in which the conductor is inserted into a closed crimping zone of a plug or a closed sleeve and is crimped by plastic deformation of the crimping zone or the sleeve. It is also possible, however, that an open crimp is created in which the plug comprises an open crimping zone into which the conductor can be inserted from above. In order to mention some examples not limiting the invention, with the crimping tool relevant here

- cable lugs according to DIN 4623,
- aluminum connectors according to DIN 46329,
- aluminum cable crimp lugs according to DIN 48201,
- cable crimp lugs according to DIN 46234,
- cable pin lugs according to DIN 46230 or
- connectors, plugs or cable lugs for a connection to a cable or conductor as they are described in the product catalogue "Werkzeuge für die professionelle Anwendung" (publication no. 10/11) of the WEZAG GmbH Werkzeugfabrik company can be crimped.

The crimp created, if it is, for example, a closed crimp, may be a hexagonal crimp, a tetragonal crimp, a B crimp, a trapezoidal crimp, a modified trapezoidal crimp, an oval crimp, a mandrel crimp or a two-mandrel crimp. An open crimp may for example be embodied as a V crimp or B crimp, roll crimp or double roll crimp.

In addition to establishing the electrical connection between the cable or conductor and the plug, a mechanical connection can be established by means of what is known as an isolation crimp. A closed isolation crimp or an open isolation crimp (especially a V crimp or B crimp, O crimp or OV crimp) may be employed. With respect to further information on

- the detailed realization of generic crimping pliers,
- possible ranges of employment of the generic crimping pliers and/or
- different possible types of crimp connections which can be established by means of the generic crimping pliers, the publication "Crimptechnik, Herstellung prozesssicherer Verbindungen von elektrischen Leitern and Steckern" of the WEZAG GmbH Werkzeugfabrik company, Die Bibliothek der Technik 342, Verlag Moderne Industrie, ISBN 978-3-68236-027-7 is referred to.

In recent years, manual pliers tools have increasingly been equipped with electronics construction units by means of which additional functions are intended to be provided (such as e.g. monitoring a pliers force or crimping force, a working stroke of pliers jaws or an assessment of completion of a work process with the pliers tool).

The invention also covers a pliers tool in which an actuation force applied onto hand levers by a hand of a user is supported or amplified by a drive, especially an electric drive, so that the pliers force or crimping force results from the sum of the actuation force and the force of a drive (possibly with a transmission of the actuation force and/or the force of the drive by a drive mechanism). A control of the absolute value of the pliers force or crimping force and/or the force of the drive is achieved by the actuation force applied by the user.

BACKGROUND OF THE INVENTION

Four-mandrel crimping pliers designated as "Micro-Crimp" are offered for sale on the web page www.rennsteig-.com, by means of which twisted pin contacts or socket contacts are to be crimped. An extension depth of the crimping mandrels can be set in steps of 0.01 mm. The basic settings can be checked by means of a norm mandrel. A variant of these four-mandrel crimping pliers is offered for sale designated as "DigiCrimp". This variant comprises an electronics construction unit which enables electronic monitoring of wear with a warning function and recall of different setting functions. In order to enable accommodation of the electric and electronic components of the electronics construction unit between cover plates of a fixed pliers part of the four-mandrel crimping pliers, the cover plates when compared to the variant of the four-mandrel crimping pliers labeled "MicroCrimp" are extended on the side of the mandrels and the receptacle for the workpiece turned away from the hand levers. In the region of the extension, a cover plate comprises a window-like opening in which a digital display is arranged. A corresponding embodiment is described in EP 2 313 235 B1, corresponding to U.S. Pat. No. 8,613,210 B2.

US 2013/0233043 A1 discloses crimping pliers equipped with a counting device for counting the completed crimping strokes of the crimping pliers. The counting device is embodied as a reed switch, which is actuated by the relative movement of a hand lever relative to a fixed pliers part, where also other contact-less or contact-based switches may be employed. For one embodiment, a battery and a counter circuit are arranged in the interior of the fixed pliers part. Additionally, a module for wireless transmittance of the counter result may be integrated here. By means of an LED, it can also be indicated to the user when a pre-set number of crimping strokes has been completed. For another embodiment, the counter circuit and the module for wireless transmittance may be held in one block on the outside of the fixed pliers part.

US 2017/0165813 A1 discloses clamping and cutting pliers with scissors-like drive kinematics, which are colloquially known as "engineers pliers" or "combination pliers". Between the two pliers parts of the engineers pliers, a space open to the outside is formed, in which an insert is accommodated. The insert comprises two shell-like housing parts which accommodate an electric circuit with a lamp, connecting conduits, a switch and a battery. With the lamp, the region between the clamping and cutting jaws and therefore a workpiece processed with the engineers pliers can be lit.

CN 203 804 813 U discloses pliers which in addition to cutting and clamping a workpiece also enable turning a screw, since an end portion of one pliers jaw is realized as a functional tip for turning a screw. In the region of a hand lever of the pliers with scissors-like actuation kinematics, an optic or acoustic signaling device is arranged, by means of which the user is informed if an electric current is present on the pliers, especially in the region of the functional tip.

SUMMARY OF THE INVENTION

The present invention relates to a manual pliers tool with a mechanical pliers part and an electronics construction unit. The mechanical pliers part comprises two pivotable hand levers, two pliers jaws movable relative to one another, a drive mechanism and a pliers head part, which is arranged between the hand levers and the pliers jaws. The drive mechanism couples the pliers jaws with the hand levers in such a way that by pivoting the hand levers the pliers jaws can be moved towards each other over a working stroke. The electronics construction unit is realized separately from the mechanical pliers part and is arranged in or on the pliers head part where it is fixed to the pliers head part. The electronics construction unit extends on two opposite sides of the pliers head part, where the electronics construction unit sandwiches the pliers head part, and comprises a connector, where the connector extends through or around the pliers head part between the two opposite sides of the pliers head part.

With the novel manual pliers tool, it is possible to provide a manual pliers tool which is improved with respect to

- the design and integration of an electronics construction unit and/or
- the design and integration of components of the electronics construction unit and/or
- the manufacture and/or assembly and/or
- enabling working with the pliers tool in narrow spaces and/or
- integration of functions.

The invention relates to a manual pliers tool which can be operated by a user by applying manual hand forces. The manual pliers tool comprises an electronics construction unit and a mechanical pliers part, by means of which the mechanical functions of the pliers tool are provided. The mechanical pliers part comprises two pivotable hand levers and two pliers jaws that are movable relative to one another (especially pliers jaws pivotable or translationally movable relative to one another). The hand levers and the pliers jaws are coupled via a drive mechanism which also may comprise a geared transmission and is e.g. based on an toggle lever drive. In this way, the pliers jaws can be moved over a working stroke by a pivoting of the hand levers induced by the user. In the working stroke, then, the workpiece is processed. When realizing the pliers tool as crimping pliers, the workpiece is crimped over the working stroke, which is achieved by means of dies formed or held by the pliers jaws.

Employment of the invention is not limited to a certain drive mechanism with respect to the concrete realization of the mechanical pliers part. In order to mention only some examples not limiting the invention, the drive mechanism may be realized according to the non-pre-published European patent application EP 18 166 739.5 or according to the documents DE 10 2008 005 472 B3, corresponding to U.S. Pat. No. 8,245,560 B2, DE 40 23 337 C1, corresponding to U.S. Pat. No. 5,153,984 A, DE 40 26 332 C2, corresponding to EP 0 471 977 B1, DE 197 13 580 C2, corresponding to U.S. Pat. No. 5,913,933 A, DE 197 53 436 C2, DE 198 07 737 C2, corresponding to U.S. Pat. No. 6,026,671 A, DE 10 2005 003 615 B3, DE 20 2008 003 703 U1, where the degrees of freedom of the pliers jaws can be designed and the arrangement of the pliers jaws and hand levers with respect to one another can be accomplished according to these embodiments and, if the pliers tool is realized as multi-mandrel crimping pliers, even actuation means or actuation discs twisted with respect to one another can be accepted as "pliers jaws".

Firstly, the invention proposes for the electronics construction unit to be realized independently of the mechanical pliers part. This means that the mechanical function of the pliers tool can even be provided if there is no electronics construction unit. This e.g. means it is possible for a pliers tool to be manufactured in two variants where one variant of the pliers tool is not equipped with an electronics construction unit while the other variant is equipped with an electronics construction unit. For both variants, the same mechanical pliers part may be used.

Possibly, realizing the electronics construction unit separately from the mechanical pliers part also leads to a simplification of manufacture and/or assembly since the mechanical pliers part on the one hand and the electronics construction unit can be manufactured at different places and possibly be pre-assembled and/or be manufactured from different materials.

Furthermore, the invention proposes for the electronics construction unit to be arranged in a special portion of the pliers tool: According to the invention, the electronics construction unit is arranged in a pliers head part of the mechanical pliers part. This pliers head part is that part of the pliers head which is arranged between the hand levers and the pliers jaws. In the region of this pliers head part, possibly at least a part of the drive mechanism with drive elements such as a toggle lever drive are arranged. If the pliers head part comprises a housing or cover plates, the housing or the cover plates is or are suitable to fix the electronics construction unit to the pliers head part and therefore the pliers tool.

The design according to the invention therefore makes use of the pliers head part that is present by default, in which way the pliers tool can be designed in an especially compact way. On the other hand, the design according to the invention is based on the realization that an extension of the pliers head past the receptacle for the workpiece and the pliers jaws (such as this is done for the product "DigiCrimp" explained in the beginning) is not only disadvantageous with respect to the construction size of the pliers tool: With such an arrangement of the electronics control unit, the pliers head of the pliers tool especially is enlarged, which makes inserting the pliers tool into narrow spaces, where e.g. a conductor crimp has to be established, difficult or even impossible.

Within the framework of the invention, the electronics construction unit is directly mounted to the pliers head part which may be achieved by any means of mounting, especially screwing, glueing, latching, locking (e.g. enabling the electronics construction unit to "snap into place" on the pliers head part) or similar.

If one assumes that the mechanical pliers part comprises a rectangular cross-section in that pliers head part where the electronics construction unit is arranged, it is possible for the electronics construction unit to comprise partial units each arranged on one side of the rectangular cross section or attached to the rectangular cross section on different sides of the rectangular cross section. According to the invention, the electronics construction unit extends on two opposite sides of the pliers head part, where these opposite sides in the aforementioned rectangular cross-section of the mechanical pliers part are the longer sides of the rectangle. These opposite sides may be embodied by the cover plates of the mechanical pliers part. The electronics construction unit sandwiches the pliers head part, so that the pliers head part is wholly or partially enclosed by the electronics construction unit. The construction unit comprises a connector which extends through or around the pliers head part. The connector may be rigid or flexible. The connector may have a purely mechanical, constructional function. However, the connector may also be conductive, comprise a conduit or a signal line or provide an electrical or electronic connection within the electronics construction unit through the pliers head part in any other way. The connector might also be functionally indistinguishable within the electronics construction unit with regard to electronics. This embodiment has the advantage of on the one hand guaranteeing reliable mounting of the electronics construction unit, especially to the mentioned cover plates of the pliers head. On the other hand, the pliers head part in the region of these opposite sides comprises an enlarged extension so that a larger number of components of the electronics construction unit or larger such components can be arranged in the region of these sides. By way of example, the electronics construction unit may comprise two plate-like parts and the connector. The two plate-like parts may then be mounted on the opposite sides of the pliers head part. The connector might e.g. be rigid and extend through the pliers head part, where for example the electronics construction unit might come apart into two parts between the connector and one of the plate-like parts or within the connector in such a way that the pliers tool can be assembled by pushing the connector or one part of the connector on one part of the electronics construction unit through or into an opening of the pliers head part from one side of the pliers head and joining the other part of the electronics construction unit from the other side of the pliers head (where the other part of the connector might also be pushed into the opening, where applicable), where the two parts of the electronics construction unit might e.g. snap, click or lock together. The electronics construction unit may also be U-shaped. In this case, the two long arms of the U would be arranged on the opposite sides of the pliers head and might be the two plate-like parts, where the short, connecting arm or "bend" of the U would be the connector, which in this case would extend around the pliers head. The whole "U" might be rigid, allowing the electronics construction unit to be pushed onto the mechanical pliers part sideways in a simple way, possibly snapping, clicking or locking into place, or the connector might e.g. be flexible.

The electronics construction unit may comprise a continuous recess having a closed circumference (also referred to as a closed edge"). In this case, the mechanical pliers part extends through the recess having the closed circumference. In other words, for this embodiment the electronics construction unit extends around the mechanical pliers part so that it is continuous in the circumferential direction. In this embodiment, the connector may be indistinguishable functionally within the electronics construction unit. It is possible in this embodiment that the electronics construction unit is realized as a kind of ring. If one views the electronics construction unit to be an oval in cross section, one or both of the sections with a smaller radius might function as the connector, extending around the pliers head part. Due to the continuous recess with the closed circumference extending through it, the electronics construction unit comprises a front aperture and a back aperture (which are connected by the continuous recess). In the region of the front aperture, the pliers jaws extend out of the electronics construction unit while the hand levers extend out of the back aperture. It is also possible that the pliers jaws or the hand levers, however, are placed in front or behind the corresponding aperture, in which way a drive element of the drive mechanism or a housing of the pliers head may extend out of the aperture.

Within the framework of the invention, the electronics control unit may be equipped with any electric or electronic components, cp. the electronics construction unit according to prior art. In further realization of the pliers tool according to the invention, the electronics control unit comprises an electronic control unit, as which also several interconnected partial control units can be understood. In order to mention only an example not limiting the invention, the control unit may be a CPU of the type "NXP Kinetis KW41Z, ARM Cortex-MO+, 48 MHz", where a storage (especially with up to 512 kB flash storage and up to 128 kB SRAM) may be assigned to the CPU. Alternatively or additionally it is possible that the electronics construction unit comprises an input element. There are various possibilities for the realization of such an input element. The input element, for example, can serve for directly entering a wish or signal of the user. In this case, the input element may for example be a switch, a rotary knob or even a keyboard. It is also possible, however, that an input element for communication with neighboring construction elements in the electronics control unit is present. For example, the input element may e.g. be a cable-bound interface (e.g. USB interface) or a wireless interface (e.g. Wi-Fi or Bluetooth). Accordingly, a wireless or wire-bound output element may be present via which (wirelessly or in a wire-bound way) the electronics construction unit communicates with an external device to transmit manual settings by the user and/or to output operating parameters, measurements or other signals by the electronics construction unit. Alternatively or cumulatively is possible for the electronics construction unit to comprise a display element, especially a (one-line or multi-line) display. Alternatively or cumulatively it is possible for the electronics construction unit to comprise a lamp which e.g. can be used as an indicator for an operating state, as an indicator of an irregular work process, as a signal device for a charge state of a battery or similar. Such a lamp may for example be an LED of any color or an RGB LED. It is also possible that the lamp, however, is employed in order to light a construction element of the pliers tool, especially a locator or the receptacle for the workpiece and/or the environment of the pliers tool in the way of a flashlight. Finally, it is possible for the lamp to provide a basic lighting of the pliers tool in order to make it optically visible, e.g. in darkened rooms or a toolbox and/or in order to signal readiness of the pliers tool or the electronics construction unit for operation via the lamp. Alternatively or cumulatively it is possible that the electronics construction unit comprises an acoustic output element. Via the acoustic output element, there may be communication with the user, e.g. in order to signal readiness for operation, to signal the completion of a working stroke when reaching the end position of the pliers jaws, to signal a signal with respect to an assessment of measured pliers force progressions and/or measured displacements of the pliers jaws and/or of progressions of the same. Alternatively or cumulatively it is possible that the electronics construction unit comprises a sensor. Such a sensor may for example be an acceleration sensor. In order to mention only an example not limiting the invention, the acceleration sensor may be a sensor "MMA8652FC" of the NXP company. Via such an acceleration sensor it can be distinguished whether the pliers tool has been laid down or is being moved in the hand of the user. If via the acceleration sensor it is detected that the pliers tool has been taken up due to acceleration occurring after longer rest, the electronics construction unit may be "woken up" by switching from a standby state optimized with regard to power consumption into a standby ready state. In order to mention only further examples not limiting the invention for realizing a sensor, the sensor may be a force sensor via which a pliers force or crimping force is measured or a displacement sensors which detects the working stroke of the pliers jaws or of any drive element of the drive mechanism. It is possible that for wireless communication with the pliers tool a 2.4 GHz radio technology according to standard IEEE 802.15.4 is used, where a "Bluetooth low energy 4.2" technology may also be employed. It is possible for the sensor to be a counter which especially may be realized as an IR proximity sensor which is sold as "AMS TCS 73327". As a display element, e.g. an OLED display may be employed, which here for example is a product sold as "VGM 096064 A5W01" and comprises a white monochrome resolution of 96×64 pixels.

There are various options for the choice of the material of the housing of the electronics construction unit and its detailed design. For example, the housing may be manufactured with an arbitrary number of plastic housing parts. For one proposal of the invention, the housing of the electronics construction unit comprises two housing parts in the way of half-shells. These two half-shell-like housing parts in a mounted state are closed in the circumferential direction, in which way they form a kind of ring. The two housing parts in the mounted state extend around the mechanical pliers part. Inside of these two half-shell-like housing parts the mechanical pliers part is arranged so that an interior space of the electronics construction unit in which the components of the electronics construction unit are accommodated on the outside is limited by the two half-shell-like housing parts while this interior space on the inner side is limited by the mechanical pliers part, especially with cover plates. Preferably, the two half-shell-like housing parts on the inner side connect closely and possibly even sealingly to the mechanical pliers part. Connecting the two housing parts to one another and/or to the mechanical pliers part can be done in an arbitrary way according to the invention. It is e.g. possible for the two housing parts to be clipped, glued, locked, latched, pressed and/or screwed to one another and/or the mechanical pliers part.

It is also possible that the housing of the electronics construction unit comprises a housing part which forms a front face of the electronics construction unit turned towards the pliers jaws. For one proposal of the invention, the housing of the electronics construction unit has three parts including the two aforementioned half-shell-like housing parts and a further housing part which forms the front face of the electronics construction unit turned towards the pliers jaws.

For a more detailed realization of this last-mentioned embodiment, the two half-shell-like housing parts are in form-locking connection with one another, which is realized with a direction of assembly oriented vertically to a longitudinal axis of the pliers tool. Generally, the half-shell-like housing parts assembled in this way could be released if they are biased with forces vertically to the longitudinal axis of the pliers tool and opposite to the direction of assembly. The further housing part which forms a front face of the electronics construction unit turned towards the pliers jaws in this case may form a form-locking connection to the half-shell-like housing parts, where for this form-locking connection a direction of assembly is used which is oriented in the direction of a longitudinal axis of the pliers tool. This form-locking connection of the further housing part to the two half-shell-like housing parts mounted with one another guarantees that releasing the two half-shell-like housing parts is at least made more difficult since it necessitates a movement of the half-shell-like housing parts vertically to the longitudinal axis of the pliers tool, which, however, is prevented by the further housing part.

For the general geometry of the housing of the electronics construction unit, within the framework of the invention there are various options. For one proposal of the invention, the housing of the electronics construction unit when viewed from above onto a pliers head plane is realized to be V-shaped on the front face turned towards the hand levers, where the connecting portion of the two legs of the V may also be rounded or flattened. The hand levers in this case each extend out the housing out of a leg of the V. In this way, an especially compact embodiment results in which the connecting region of the legs of the V may extend into the interspace formed between the two hand levers.

Within the framework of the invention, the electronics construction unit can comprise at least one circuit board, which holds the electric and electronic components of the electronics construction unit and/or an electronic control unit. For one proposal of the invention, on each side of the pliers head part a circuit board is arranged. It is possible for the circuit boards to be screwed to the housing parts so that they do not have to be connected to the mechanical pliers part. In the simplest case, all components of the electronics construction unit are fixed to the housing, which in turn is fixed to the mechanical pliers part.

In order to use two circuit boards arranged on opposite sides of the pliers head part, the two circuit boards may be connected via a cable. This cable may be the connector or may be part of the connector. It is possible for the cable to extend through a recess of the mechanical pliers part. For a further proposal of the invention, however, the two circuit boards are connected to one another via a cable which in the circumferential direction extends around the mechanical pliers part from the one circuit board to the other circuit board. For the aforementioned example, according to which the mechanical pliers part in the region of the electronics construction unit comprises a rectangular cross-section the longer sides of which are formed by cover plates, the two circuit boards are each arranged in the region of an outer side of a cover plate and the cable extends from these longer sides of the rectangular cross-section around the corners of the rectangle and along a shorter side of the rectangular cross-section from one circuit board to the other circuit board. This cable may e.g. be a flexible ribbon cable. In this case, the cable extends in an annular inner space, which on the inside is limited by the mechanical pliers part and on the outside is limited by a housing of the electronics construction unit.

For an embodiment of the pliers tool according to the invention, the housing of the electronics construction unit comprises a partial region that is transparent or partially transparent to light. For example, this partial region may be formed by the further housing part which forms the front face of the electronics construction unit turned towards the pliers jaws. For this embodiment, a lamp is arranged in the interior of the housing of the electronics construction unit. This lamp is arranged and oriented in such a way that light emitted by the lamp impinges onto the transparent or partially transparent partial region. If the partial region is transparent, by means of the lamp an environment of the electronics construction unit, that is, e.g. a locator of crimping pliers or a receptacle for the workpiece, may be lit by means of the lamp. It is also possible for the light of the lamp to pass through the transparent partial region and enable use in the way of a flashlight function via which an environment of the pliers tool can be lit. If the light emitted by the lamp on the contrary impinges onto a partially transparent partial region in the region of which there is also reflection, the partial region may be backlit, in which way e.g. a kind of colored ring may be created on the electronics construction unit. Via this backlit partial region, different operating states of the electronics construction unit may be made visible depending on the lighting. For example, via a flashing partial region it may be signalized that establishing a contact via a wireless connection is attempted, while via permanent backlighting it may signalized that a contact via the wireless connection has been established. Alternatively or additionally it is possible that with the backlighting of the partial region, possibly with another color, it is signalized that the electronics construction unit is ready for operation. With respect to further possibilities of using the light emitted by the lamp, the orientation of the lamp and the integration into the pliers tool, in an exemplary way documents US 2011/0235312 A1 and EP 3 312 949 A1, corresponding to US 2018/0115132 A1, are referred to.

It is possible for the electronics construction unit to be supplied with electric energy via a cable connectable to the pliers tool. Preferably, however, the electronics construction unit is supplied with electric energy via a battery or an accumulator. A battery or an accumulator, especially a button cell, may e.g. be integrated into the electronics construction unit. For another proposal of the invention, the battery or the accumulator is integrated into a hand lever, so that the battery or the accumulator is realized and arranged separately from the electronics construction unit and is connected to the electronics construction unit via an electric supply cable. This embodiment of the invention utilizes the construction space that is present in the hand lever anyway.

For a special embodiment, the hand lever comprises a metallic hand lever bar. A plastic handle extends around this metallic hand lever bar. In this case, an interspace is formed between the handle and the hand lever bar and the battery or the accumulator is arranged in this interspace. A receptacle for the battery or the accumulator may e.g. be held on the hand lever bar.

A further proposal of the invention relates to detecting a movement of the drive mechanism and therefore the movement of the pliers jaws. It is proposed for the drive mechanism to comprise a drive element which is arranged on the outside of the mechanical pliers part. In order to mention only an example not limiting the invention, this may be a compression lever of a pliers tool which is realized according to the non-prepublished European patent application EP 18 166 739.5 and in which the compression lever is arranged outside of cover plates of the pliers head. This drive element is moved (possibly with a small distance) relative to a sensor of the electronics construction unit. The sensor can detect the movement of the drive element and therefore of the drive mechanism and the pliers jaws. The sensor may detect a displacement. It is, however, also possible for the sensor only to signal switching when a pre-set partial stroke of the working stroke is reached or 15% of the working stroke is surpassed or the closed position is reached. For example, a sensor of the "IR proximity sensor" type with a counter may be employed (cp. the commercially sold product "AMS TCS 73327").

If the mechanical pliers part in the region of the drive head comprises cover plates between which pliers jaws and/or drive elements of the drive mechanism are arranged, the interspace formed between the cover plates may be open to the outside, which may not be attractive to look at and also may result in objects or dirt entering. Is also possible that via this interspace open to the outside access to the electronics construction unit is provided, which may be undesirable. In order to avoid this, the invention proposes that the mechanical pliers part comprises a cover element in the region of the pliers head. The cover element closes off an interspace formed between the cover plates to the outside at least over a part of the circumference of the pliers head, which is preferably the case in that portion of the circumference neighboring the electronics construction unit and/or in the interior of the electronics construction unit. To mention only an example not limiting the invention, the cover element may comprise a T-shaped cross-section. The length of the upper cross leg of the T corresponds to the distance of the cover plates. The upper cross leg of the T therefore rests against the front faces of the cover plates and closes off the interspace. The vertical leg of the T may enter into the interspace and may be pressed or clipped in a form-locking and/or friction-locking way into the interspace or the cover plates limiting the interspace.

A further embodiment of the invention focuses on guaranteeing further functions by means of a control logic of the electronic control unit:

- It is possible that by means of the control logic of the electronic control unit a charge state of a battery or an accumulator is analyzed. It is e.g. possible for there to be an indication via an LED or a display when a low charge state is detected. It is also possible that when a threshold value of a charge state of the battery is fallen below an energy saving mode is activated in which e.g. a lamp or a display is dimmed or even deactivated.
- It is possible that the control logic of the electronic control unit analyzes a crimping pliers force or a crimping pliers displacement (or a displacement of a component of the drive mechanism correlated with it) derived by a sensor, which may be done taking into account a calibrating factor, storage for later further processing, a comparison to a threshold value, a comparison to a nominal curve or similar.
- It is possible that the control logic of the electronic control unit derives the number of completed working strokes, which may be for example the working strokes completed by the pliers tool since its manufacture or since a last maintenance or the working strokes completed on one day or within a pre-set time period. It is possible that the number of completed working strokes is compared to a threshold value, in which way then when the threshold value is surpassed it may be signalized to a user that the pliers tool will have to undergo maintenance directly or after a number of further working strokes or even will become unusable. It is also possible that when a pre-set value for the maximum number of completed working strokes is surpassed the pliers tool is deactivated by the electronic control unit, which may for example be achieved by blocking the moving parts of the pliers tool or by releasing a coupling integrated into the drive mechanism. With respect to further details for determining and analyzing a number of completed working strokes, the European patent application EP 2 995 424 A1, corresponding to U.S. Pat. No. 9,864,948 B2, is referred to.
- It is also possible that the control logic of the electronic control unit makes an analysis of a processing process carried out with the pliers tool. This analysis may for example be achieved by a determined pliers force (e.g. a maximum of the crimping force or the crimping force to reach a pre-set partial stroke of the working stroke)

lying within a pre-set range of the pliers force or a progression of the pliers force being within preset tolerances for an ideal progression of the pliers force.

It is possible that the control logic of the electronic control unit effects a storage of data, especially the number of completed working strokes, discrete values or progressions of the pliers force and/or the displacement of the pliers jaws and similar. The data stored in this way can be read out later and employed to document the work result generated with the pliers tool.

The invention also comprises embodiments in which data are stored, such as e.g. the number of completed working strokes, where data stored in this way can only be read out by the manufacturer, however, in which way the manufacturer can assess a possible It is possible for the control logic of the electronic control unit to carry out energy management in such a way that it is avoided for the electronics construction unit to use too much electric energy when the pliers tool is not used at all and rests e.g. in a toolbox or on a table. For this embodiment, the pliers tool generally takes up a standby mode in which the electric power consumption is minimized. In this case, however, in the standby mode a signal of an acceleration sensor is analyzed in such a way that a movement of the pliers tool is especially detected by means of a measured acceleration occurring. If such a movement of the pliers tool due to the pliers tool being taken up by the user is detected, the control logic of the electronic control unit activates a standby ready mode leaving the standby mode. In the standby ready mode, an enlarged functionality of the electronics construction unit can be provided so that the electronics construction unit is "woken up". For one embodiment of the invention, in the standby ready mode it is detected e.g. via a sensor if there is an operation of the pliers tool. The sensor can e.g. detect whether the working stroke is completed, which may be achieved via a displacement sensor or an end position switch. Such a monitoring whether there is an operation of the pliers tool can e.g. be carried out for a pre-set timespan (especially 10 seconds) after the switch to the standby ready mode. If within this time span the pliers tool is not operated, it automatically returns to the standby mode. It is also possible that a return to the standby mode is induced by the control logic if after activating the standby ready mode it is detected via the acceleration sensor that the pliers tool for a pre-set timespan is in a rest state without a movement occurring.

It is possible that for the case of an operation of the pliers tool being detected via a sensor (possibly after switching from the standby mode into the standby ready mode as explained before) a display and/or a lamp is actuated by means of the control logic of the electronic control unit. In the case of the lamp, e.g. readiness for operation of the pliers tool may be signaled to the user. Furthermore, by means of activating the display, displaying the information relevant to the user on the display may be initiated.

If by means of the control logic it is detected that for a pre-set first time span no operation of the pliers tool has occurred or for a pre-set second timespan no movement of the pliers tool has occurred, a display and/or a lamp may be deactivated. For this embodiment, the first time span is preferably longer than the second timespan.

The control logic of the electronic control unit may be responsible for operating a wireless sending and/or receiving device. Via the receiving device, e.g. the pliers tool and/or the electronics construction unit may be configured. On the contrary, data with respect to the working process carried out may e.g. be transmitted to an external analysis device via the wireless sending device.

It is possible that the control logic of the electronic control unit controls at least one lamp (e.g. an LED). This control may be activating and deactivating the lamp, changing the color of the lamp, changing from a permanent to a flashing operating mode of the lamp and similar.

It is possible that the control logic of the electronic control unit dims a lamp or a display when it is recognized that a charge state of a battery or an accumulator falls below a threshold value, in which way the energy consumption of the pliers tool is reduced.

It is possible that the control logic of the electronic control unit analyzes the signal of a pushbutton that can be actuated by a user in that when the pushbutton is actuated for a first time span a lamp is activated while when the pushbutton is actuated for a second timespan a wireless connection is activated. In this way, e.g. when the pushbutton is actuated for the first time span the lamp may be activated in order to activate lighting the environment of the pliers tool, that is, a function similar to a flashlight, while when the pushbutton is actuated for the second timespan establishing a connection (e.g. via Bluetooth) is enabled.

It is possible that the control logic enables (re-) configuration of the pliers tool, which may be achieved via wireless or wire-bound communication or even by direct input on an input field of the pliers tool. In order to mention only some examples not limiting the invention, the configuration may be that a name of the user or the company in which the pliers tool is used or a name or a designation of the manufacturer are "deployed" onto the pliers tool. It is, however, also possible that the configuration includes transmitting calibrating factors for sensors employed in the pliers tool or informing the pliers tool which kind of workpiece is to be processed with the pliers tool, where possibly different operating modes of the pliers tool may be controlled by the control logic.

It is possible that the control logic detects whether a closed position of the hand levers has been reached. This may be achieved by analyzing the signal of a sensor detecting a continuous displacement or an end position switch. This may, on the one hand, be used for counting the working strokes of the pliers tool and on the other hand for analyzing whether the working stroke of the pliers tool has been completed in a correct fashion.

It is possible that the control logic of the electronic control unit controls a localization function via which a localization of the pliers tool is possible. Alternatively or additionally it is possible for the control logic to control a theft protection function of the pliers tool. If e.g. the pliers tool comprises GPS and a sending and/or receiving device, e.g. with a SIM card, when the pliers tool is searched for a current position of the pliers tool can be transmitted e.g. to a smartphone. It is, however, also possible that the localization function is merely activating the pliers tool to emit light or emit an acoustic signal by means of an external device such as a smartphone, based on which finding the pliers tool is made easier. It is furthermore possible that a signal for activating the theft protection function is transmitted to the pliers tool, due to which the pliers tool may be blocked by a locking mechanism control by an actuator or a coupling of the drive mechanism is transferred to a released state.

It is furthermore possible that the control logic of the electronic control unit provides an electronic insertion check via which a check is carried out whether a workpiece has been inserted into the pliers jaws according to specification. This may be achieved e.g. via a contact in the region of the receptacle for the workpiece of the pliers tool. Depending on a contact force or actuation of the contact it can then be derived by means of the control logic whether the workpiece has been inserted into the receptacle correctly or not.

Furthermore, the control logic may be responsible for controlling a display which e.g. displays a name or designation of a manufacturer, an owner or a user, a charge state of a battery or an accumulator, a measured pliers jaw force or a measured pliers jaw displacement or a progression of these, a number of completed working strokes or a number of remaining working strokes, the result of an assessment of a processing process carried out with the pliers tool, the result of a comparison of a derived number of completed working strokes to a threshold value and/or an indication with respect to the necessary maintenance of the pliers tool.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

In the following, the invention is further explained and described with respect to preferred exemplary embodiments illustrated in the drawings.

DETAILED DESCRIPTION

Figure 1:
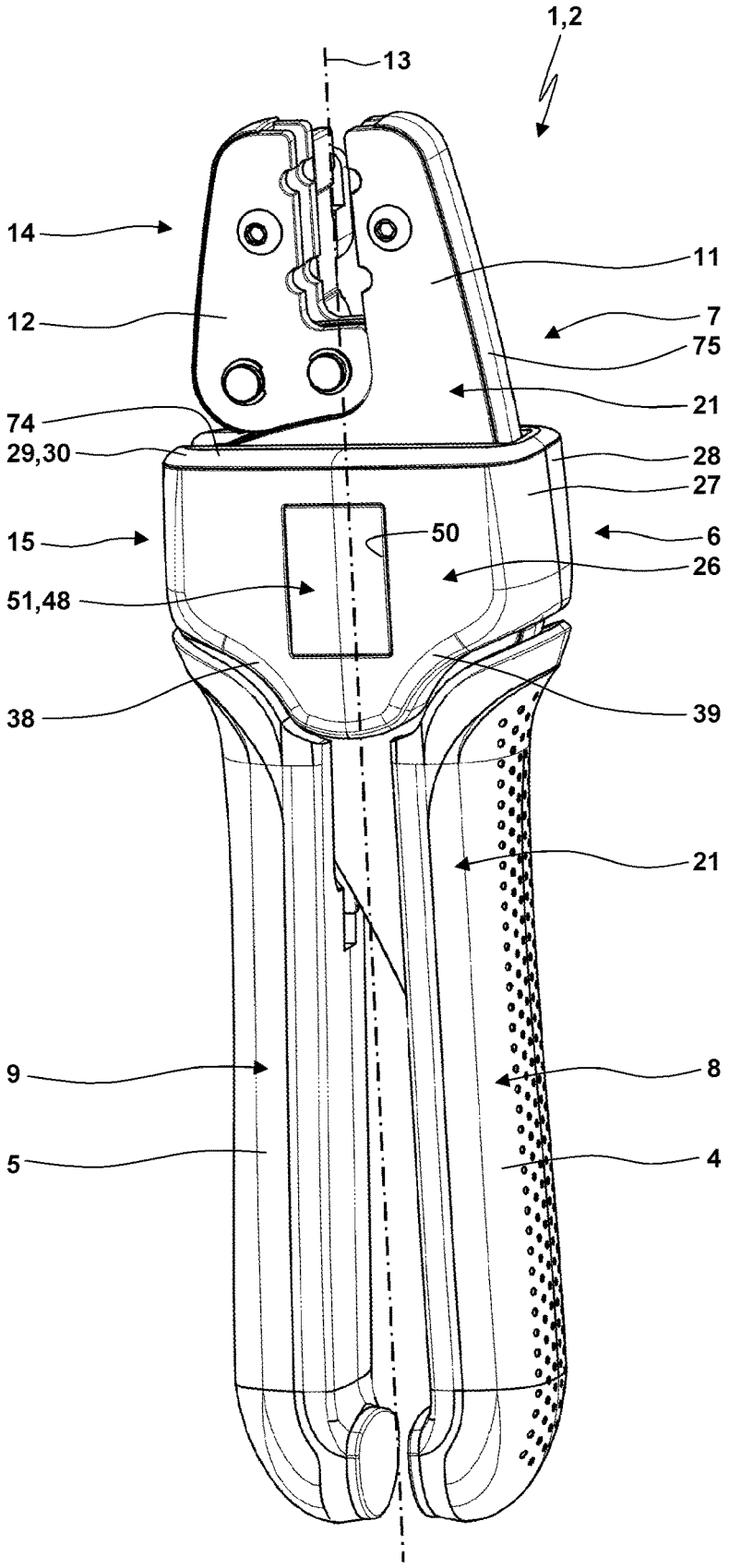
FIG. 1 in a three-dimensional view shows a pliers tool embodied as crimping pliers.
Figure 2:
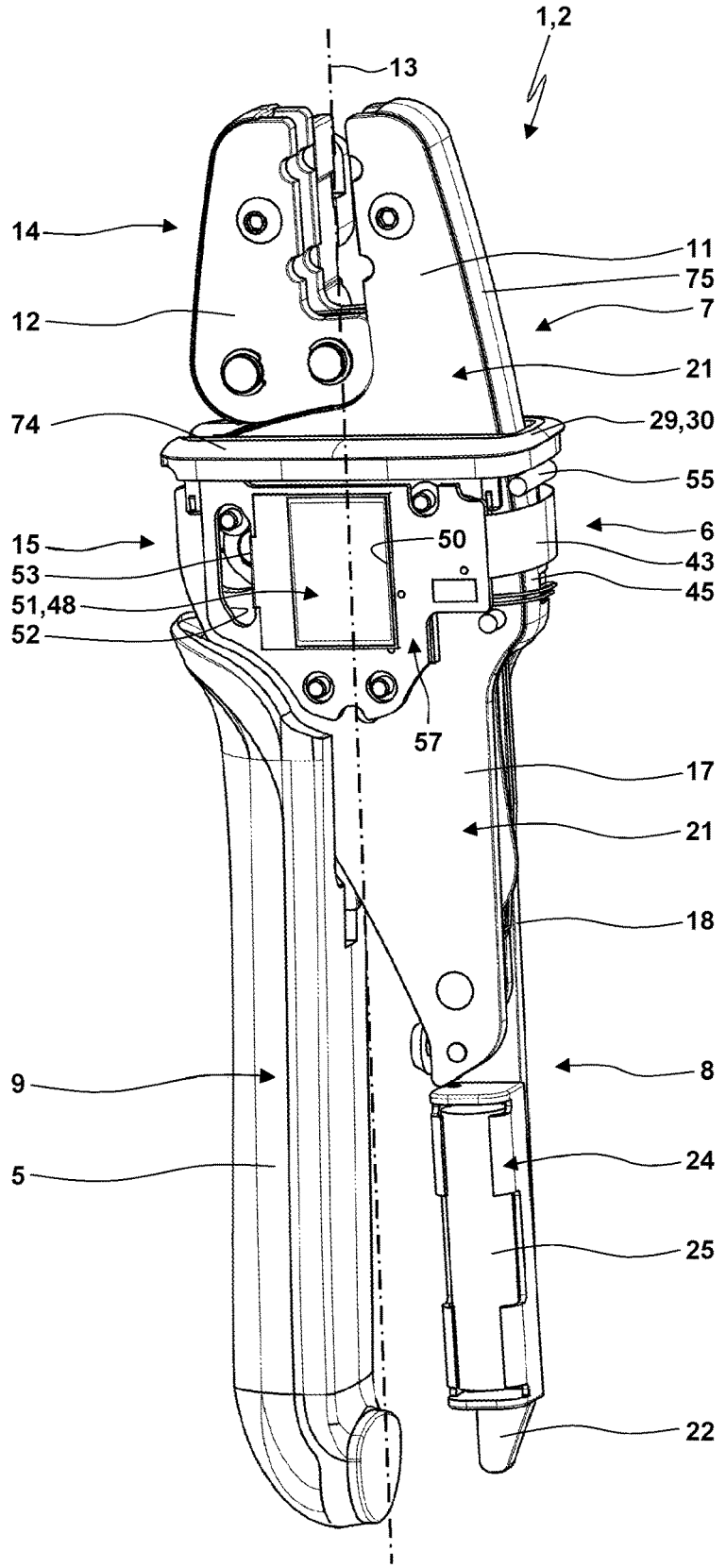
FIG. 2 shows the pliers tool according to FIG. 1, with the pliers tool being partially disassembled.
Figure 3:
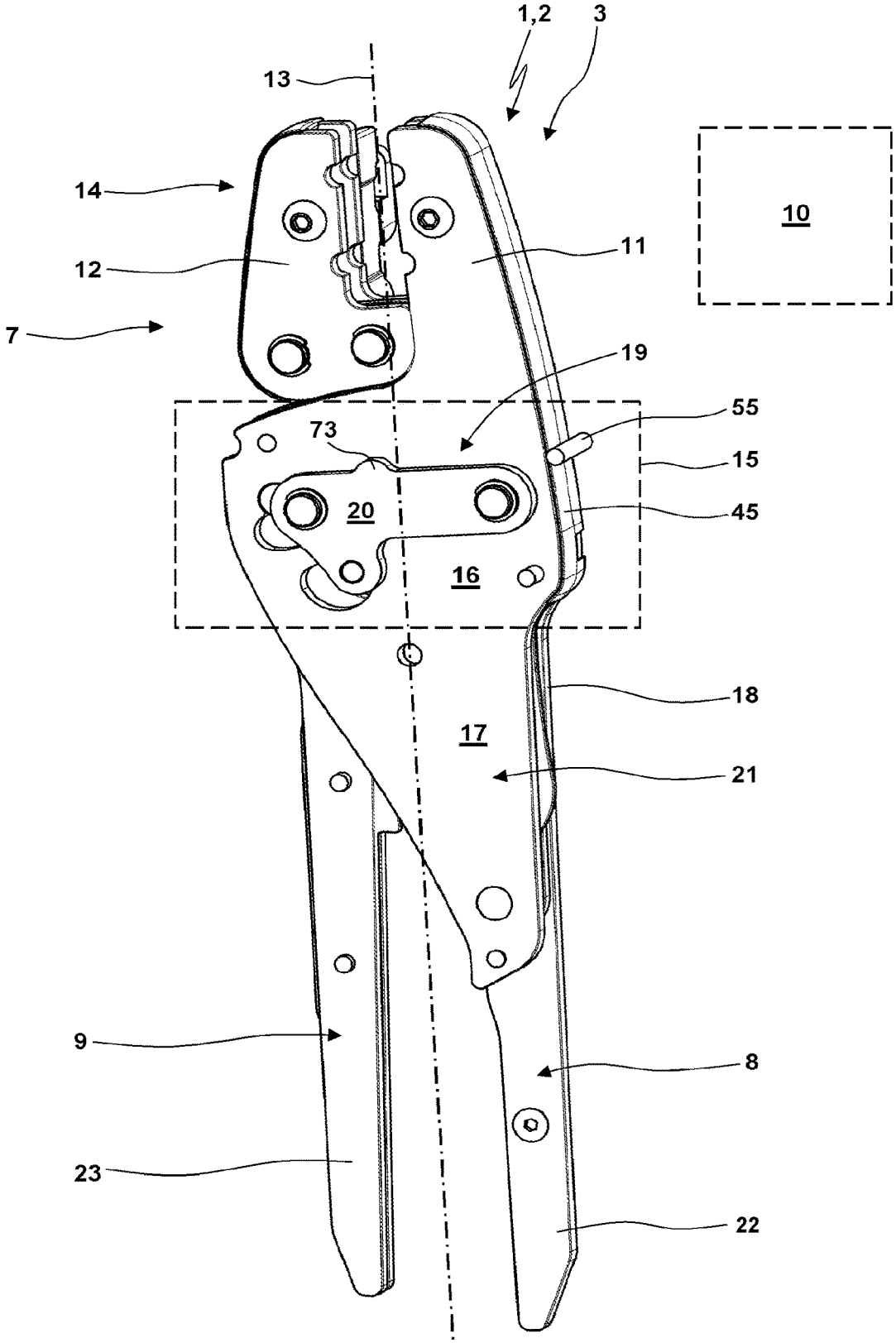
FIG. 3 shows the pliers tool according to FIGS. 1 and 2 in a more disassembled state.
Figure 4:
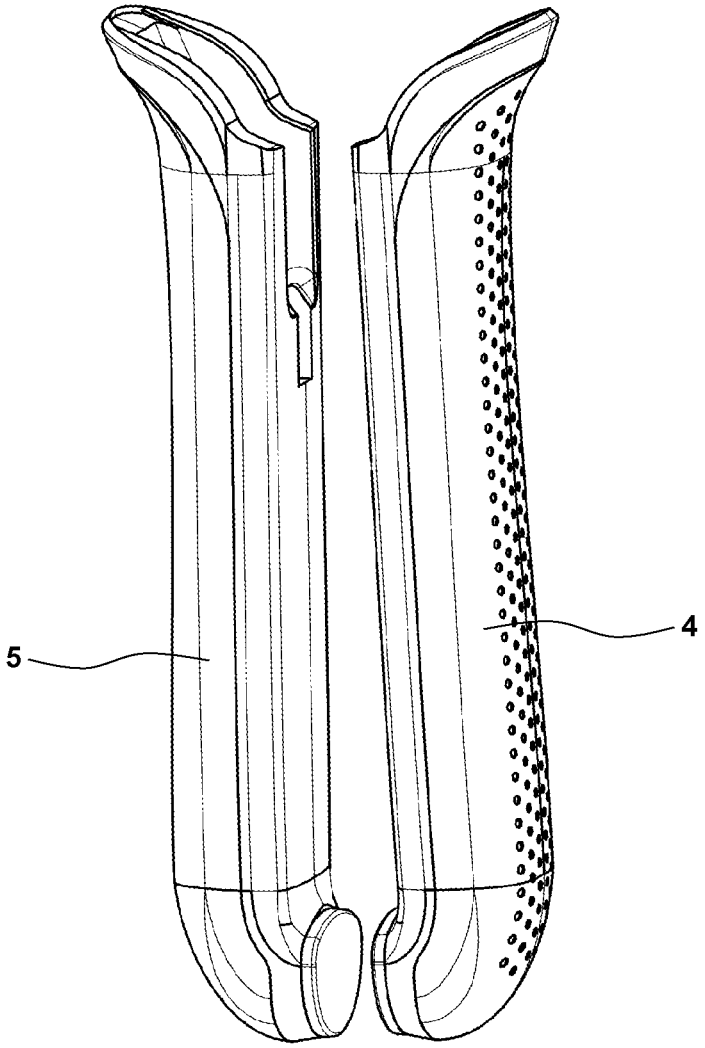
FIG. 4 shows handles of hand levers of the pliers tool according to FIGS. 1 to 3 in a three-dimensional view.

Referring now in greater detail to the drawings, FIG. 1 shows a pliers tool 1. The pliers tool shown in FIG. 1 is embodied as crimping pliers 2, shown in a closed position and in a completely assembled state. FIGS. 2 and 3, on the contrary, show the crimping pliers 2 in different partially disassembled states. According to FIG. 3, due to the disassembly only a mechanical pliers part 3 remains (where, however, the mechanical pliers part 3 differently from FIG. 3 may also comprise the handles 4, 5 removed in FIG. 3). The mechanical pliers part 3 is a completely functional pliers tool 1', by means of which the desired processing of the workpiece can be achieved. The further construction elements removed from the mechanical pliers part 3, especially an electronics construction unit 6, only provide further functions which are not involved in the mechanical processing of the workpiece itself.

The mechanical pliers part 3 comprises a pliers head 7 and hand levers 8, 9 (which may be realized with the handles 4, 5 not shown in FIG. 3). The pliers head 7 extends in parallel to a pliers head plane 10. The pliers head plane 10 is inclined with a very small acute angle with respect to the plane of drawing according to FIGS. 1 to 3.

The hand levers 8, 9 and the pliers jaws 11, 12 over the working stroke of the crimping pliers 2 move in the pliers head plane 10, which for the embodiment shown is achieved by pivoting around a pivoting axis oriented vertically to the pliers head plane 10. The crimping pliers 2 comprise a longitudinal axis 13 which corresponds to the main direction of extension of the crimping pliers 2 and corresponds to the angle bisector of the hand levers 8, 9 or is oriented parallel to a fixed hand lever 8 and/or parallel to a fixed pliers jaw 11.

The pliers head 7 comprises a first pliers head part 14, in the region of which the pliers jaws 11, 12 are arranged, and a second pliers head part 15, which is arranged between the first pliers head part 14 and the hand levers 8, 9.

In the region of the pliers head part 15, the crimping pliers to comprise a housing 16 not moved over the working stroke. For the embodiment shown, the crimping pliers 2 are realized with a plate-like construction. In this case, the housing 16 is formed with cover plates 17, 18.

For the embodiment shown, the housing 16 or the cover plates 17, 18 are rigidly connected to a fixed hand lever 8 and a fixed pliers jaw 11, so that the pliers jaw 11 over the working stroke of the crimping pliers 2 does not undergo a relative motion with respect to the hand lever 8. These fixedly connected components form a fixed pliers part 21. In the region of the pliers head part 15, the hand levers 8, 9 are coupled to the pliers jaws 11, 12 via a drive mechanism 19, which for the embodiment shown is only true for the coupling of the movable hand lever 9 to the movable pliers jaw. Any drive mechanism 19 can be employed here, which preferably comprises a toggle lever drive with a compression lever 20. The drive elements of the drive mechanism 19 may be arranged between the cover plates 17, 18 and/or outside of these.

It can be seen in FIG. 3 that the compression lever 20 of the drive mechanism 19 lies outside of a cover plate 17. Over the working stroke, there is a relative motion of the compression lever 20 with respect to the fixed pliers part 21 which is realized with the hand lever 8, the housing 16, which here is embodied by the cover plates 17, 18, and the fixed pliers jaw 11.

With respect to the further realization of the drive mechanism 19, the drive elements employed here, the coupling of the drive elements with one another and with the hand levers 8, 9 and the pliers 11, 12 and the design of the drive elements and the pivot bearings for the drive elements, the hand levers 8, 9 and the pliers jaws 11, 12 the non-prepublished European patent application EP 18 166 739.5 is referred to. Within the framework of the invention, however, any other pliers tool may be employed in which for example the pliers jaws are not pivoted relative to one another but in which there is a translational movement of the pliers jaws with respect to one another and/or the hand levers are coupled to the pliers jaws via another drive mechanism; cp. also the embodiments of pliers tools according to the prior art mentioned in the beginning. It is only important for the pliers tool to comprise a pliers head part 15 which comprises a housing 16 and is arranged between the pliers jaws 11, 12 and the hand levers 8, 9.

The hand levers 8, 9 each comprise plate-like hand lever bars 22, 23 onto which the handles 4, 5 may be pushed from the end region turned away from the pliers head 7 and be fixed to them, which may be achieved e.g. by a compressed connection and/or gluing. A holder 24 for a battery or accumulator 25 is fixed to the hand lever bar 22 which is part of the fixed pliers part 21.

The electronics construction unit 6 comprises a housing 26. The housing 26 comprises two half-shell-like housing parts 27, 28 and another housing part 29 which forms a kind of lid 30.

Figure 5:
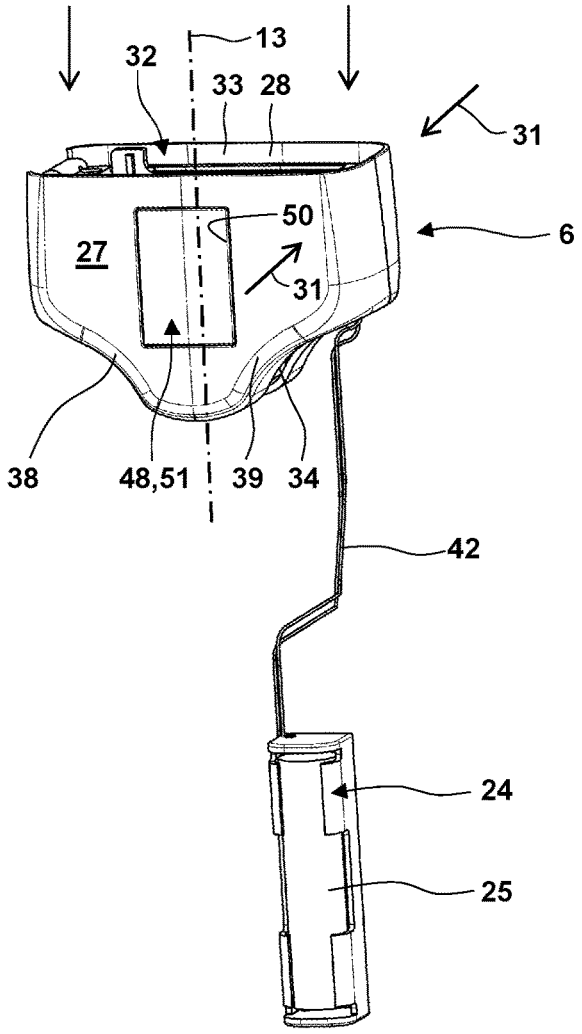
FIG. 5 shows an electronics construction unit of a pliers tool according to FIGS. 1 to 3 with a removed lid and a connection to a holder for a battery or an accumulator via a cable.
Figure 6:
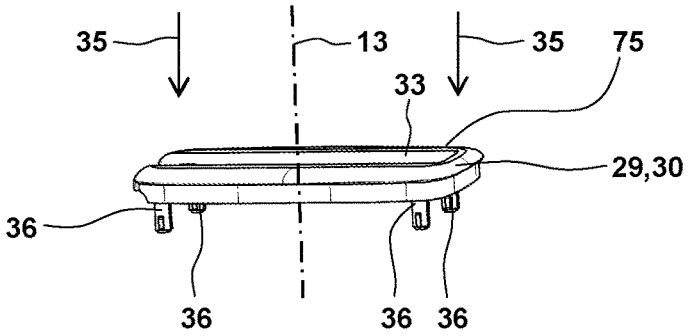
FIG. 6 in a three-dimensional view shows the lid removed from the electronics construction unit according to FIG. 5.
Figure 7:
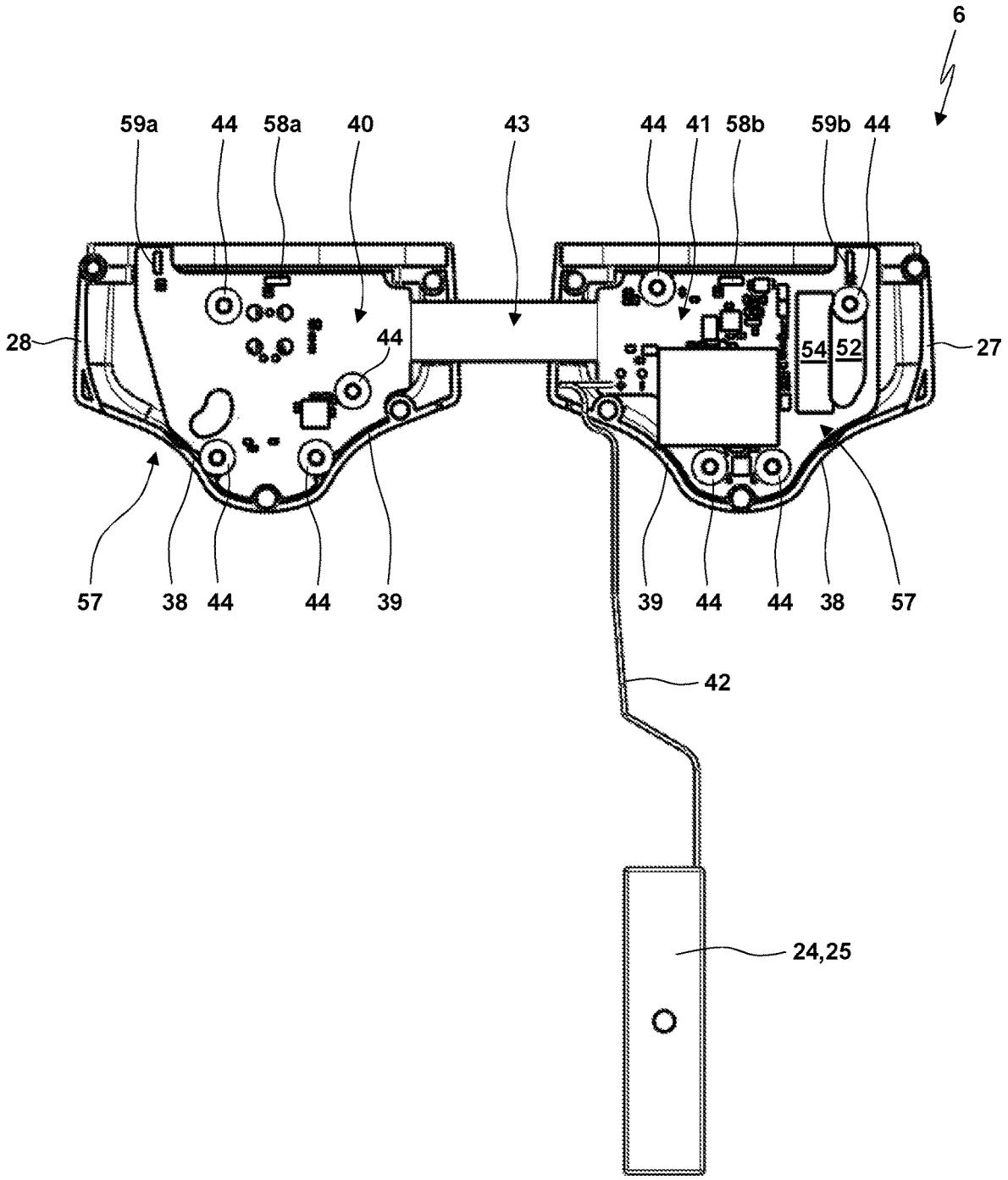
FIG. 7 shows half-shell-like housing parts of the electronics construction unit with circuit boards arranged within them, which are connected to each other via a cable, and a connection of the electronics construction unit to a battery or an accumulator via a cable.

FIG. 5 shows the assembly of the two parts 27, 28 with one another while FIG. 6 shows the lid 30. The housing part 27, 28 are joined in a direction of assembly 31 oriented vertically to a separating plane of the housing parts 27, 28 (which here corresponds to the pliers head plane 10). In order to achieve this, trunnions or protrusions of a housing part 27, 28 or pins formed separately from the housing parts 27, 28 (cp. the connecting pin 55) along the direction of assembly 31 enter into corresponding openings of the housing parts 27, 28, which preferably is done establishing a compressed connection.

The two housing parts 27, 28 form an recess 32 oriented in the direction of the longitudinal axis extending through the housing parts 27, 28, with a front aperture 33 turned towards the pliers head part 14 and with a back opening 34 turned towards the hand levers 8, 9.

In order to completelyassemble the housing 26, the lid 30 is brought into a connection with the assembled housing parts 27, 28 in a direction of assembly 35 oriented parallel to the longitudinal axis 13. The lid 30 comprises trunnions 36 protruding in the direction of assembly 35 which enter into recesses or bores 37 of the housing parts 27, 28, especially with a press fit.

The housing 26 when viewed vertically to the pliers head plane 10 in the region of its front face turned towards the hand levers 8, 9 is approximately V-shaped with legs 38, 39 of the V. In the region of the legs 38, 39, the hand levers 8, 9 extend from the housing 26 of the electronics construction unit 6 via the back opening 34.

In the interior of the housing 16, the electric and electronic components of the electronics construction unit 6 are arranged. This interior is limited to the outside by the housing parts 27, 28, 29 and is limited to the inside by the housing 16 of the mechanical pliers part 3, which here is embodied by the cover plates 17, 18.

The electronics construction unit 6 comprises two circuit boards 40, 41. The circuit board 41 is supplied with electric energy by the battery or the accumulator 25 via a cable 42. The circuit board 40, 41 are connected to one another via a flexible cable 43. The cable 43 guarantees the circuit board 40 is supplied with energy by the circuit board 41 (and therefore by the battery or the accumulator 25) on the one hand. On the other hand, an exchange of data between the two circuit boards 41, 42 takes place via the cable 43. The circuit boards are each screwed to a corresponding housing part 27, 28 via screws 44. If the electronics construction unit 6 is mounted to the mechanical pliers part 3, the circuit boards 40, 41 extend on the outside of the housing 16, here embodied by the cover plates 17, 18, lying outwardly of the housing 16 or the cover plates 17, 18, where preferably there is no electric contacting between the housing 16 and the circuit boards 40, 41. In this mounted state, the cable 43 in a cross section of the mechanical pliers part 3 extends in a U-shaped way around a front face 45 of the mechanical pliers part 3 from a front side of the mechanical pliers part 3 to a back side of the mechanical pliers part 3 (see FIG. 2). In this way, the cable 42 is part of a connector; the connector being that part of the electronics construction unit 6 extending between the front side and the back side of the mechanical pliers part 3. Those sections of the housing parts 27, 28 extending between the front side and the back side of the mechanical pliers part 3 are also parts of this connector.

In the region of the circuit board 40, an input element 46 is arranged which here is a pushbutton 47. In the region of the circuit board 41, a display 48 is arranged. The circuit board 40 serves for processing the input signal entered by the user via the input element 46 while the circuit board 41 serves for controlling the display 48.

The housing part 28 comprises a tongue-like cut under which the pushbutton 47 is arranged. If the user exerts pressure forces onto the tongue-like section 49 of the housing part 28 with their finger, the pushbutton 47 may be actuated.

Figure 8:
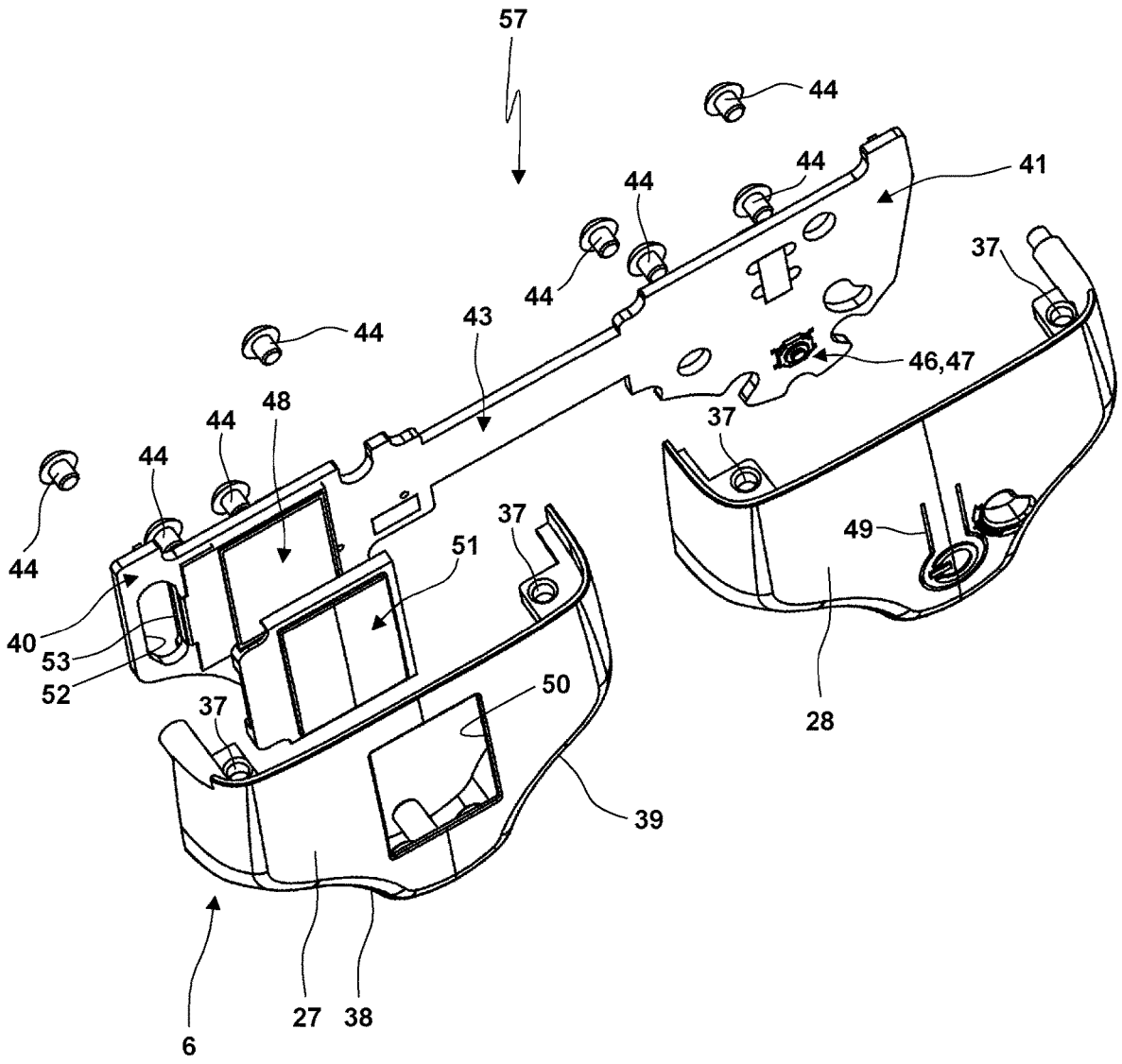
FIG. 8 shows the construction elements of the electronics construction unit according to FIG. 7 in an exploded view.

The housing part 27 comprises a window-like aperture 50. Within and behind the aperture 50, a cover pane 51 is arranged which protects the display 48 arranged behind it. As can be seen especially in FIG. 8, the circuit board 40 comprises a recess 52 formed here by an elongated hole. A connecting cable 53 is guided through the recess 52 from the display 48 to the other side of the circuit board 40, where the connecting cable 53 is connected to an electric connection element 54, via which the circuit board 40 controls the display 48.

Figure 9:
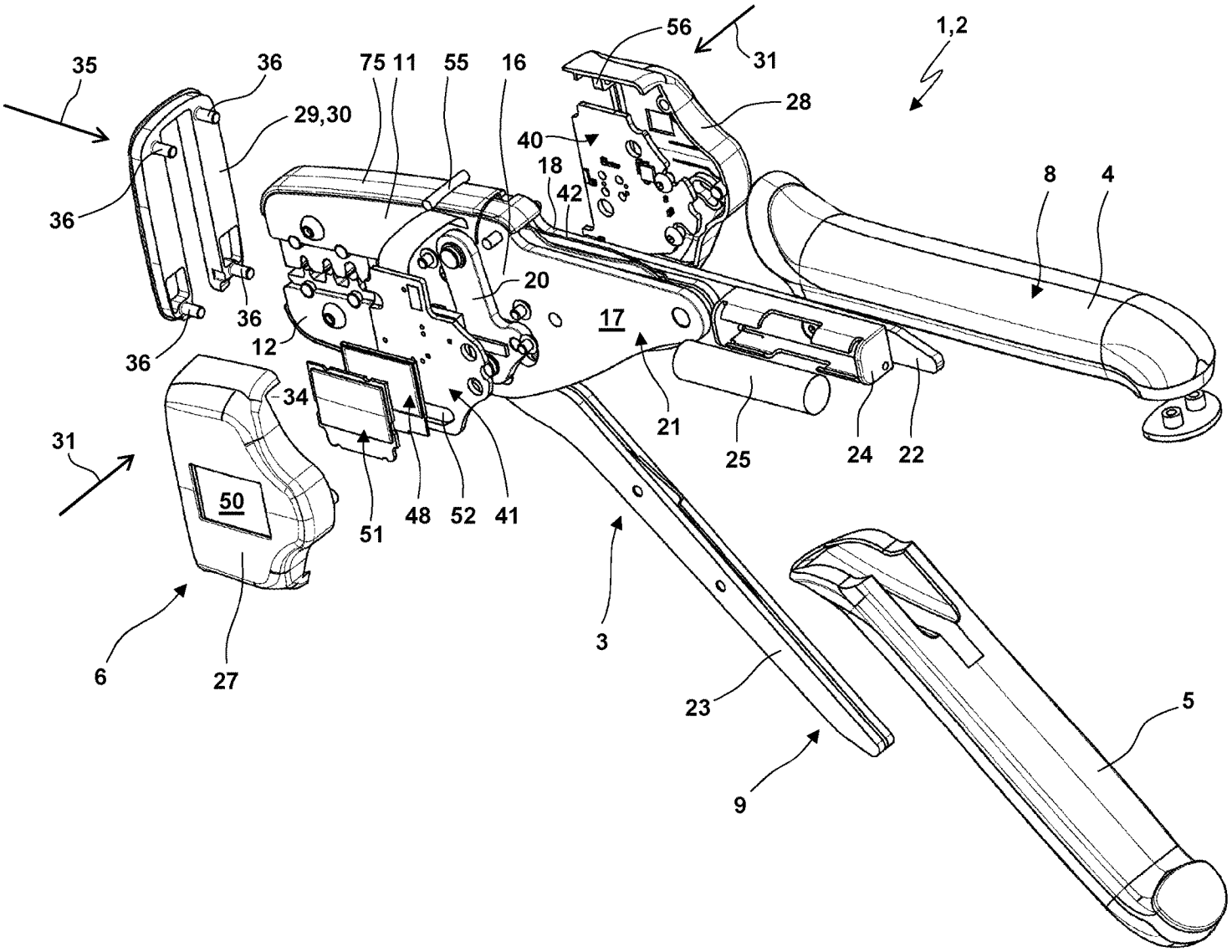
FIG. 9 shows a pliers tool according to FIGS. 1 to 3 in a three-dimensional exploded view.

In the exploded view according to FIG. 9, the lid 30 is realized in a U-shaped way. The base leg of the U on the upper side of the mechanical pliers part 3 rests against the front face 45 in the region of the fixed pliers part 21. The side legs of the U, on the contrary, extend along the housing 16, which here is embodied by the cover plates 17, 18. The lid 30 is open on the side of the movable pliers jaw 12 and the movable hand lever 9, so that possibly for large opening angles of the pliers jaws 11, 12 the movable pliers jaw 12 can extend downwardly from the lid 30. Possibly, the housing parts 27, 28 on the underside may comprise a corresponding slit, which enables a large opening angle of the movable pliers jaw 12.

In FIGS. 3 and 9 a connecting pin 55 can also be seen which in the direction of assembly 31 enters into the housing parts 27, 28.

Via the circuit boards 40, 41, lamps 58, 59 are controlled. For example, the lamps 58 may be a white LED while the lamp 59 is an RGB LED. For the embodiment shown, the circuit boards 40, 41 each comprise a lamp 58*a*, 58*b* and a lamp 59*a*, 59*b*.

The housing parts 27, 28 are not transparent to light. The housing part 29, on the contrary, is completely or in a region corresponding to the lamps 58 and 59 partially or completely transparent or translucent. Preferably, the housing part 29 is transparent in the region of a white lamp 58, so that by means of the light emitted by the lamp 58 a region outside the electronics construction unit 6 can be lit. On the contrary, an RGB lamp 59 may be arranged in a partially transparent partial region 74 of the housing part 29 or one that scatters the light diffusely so that this partial region is backlit by the RGB lamp 59 so that in the region of the lid 30 towards the outside a colored stripe or a colored ring can be generated with suitable control of the RGB lamp 59.

Figure 10:
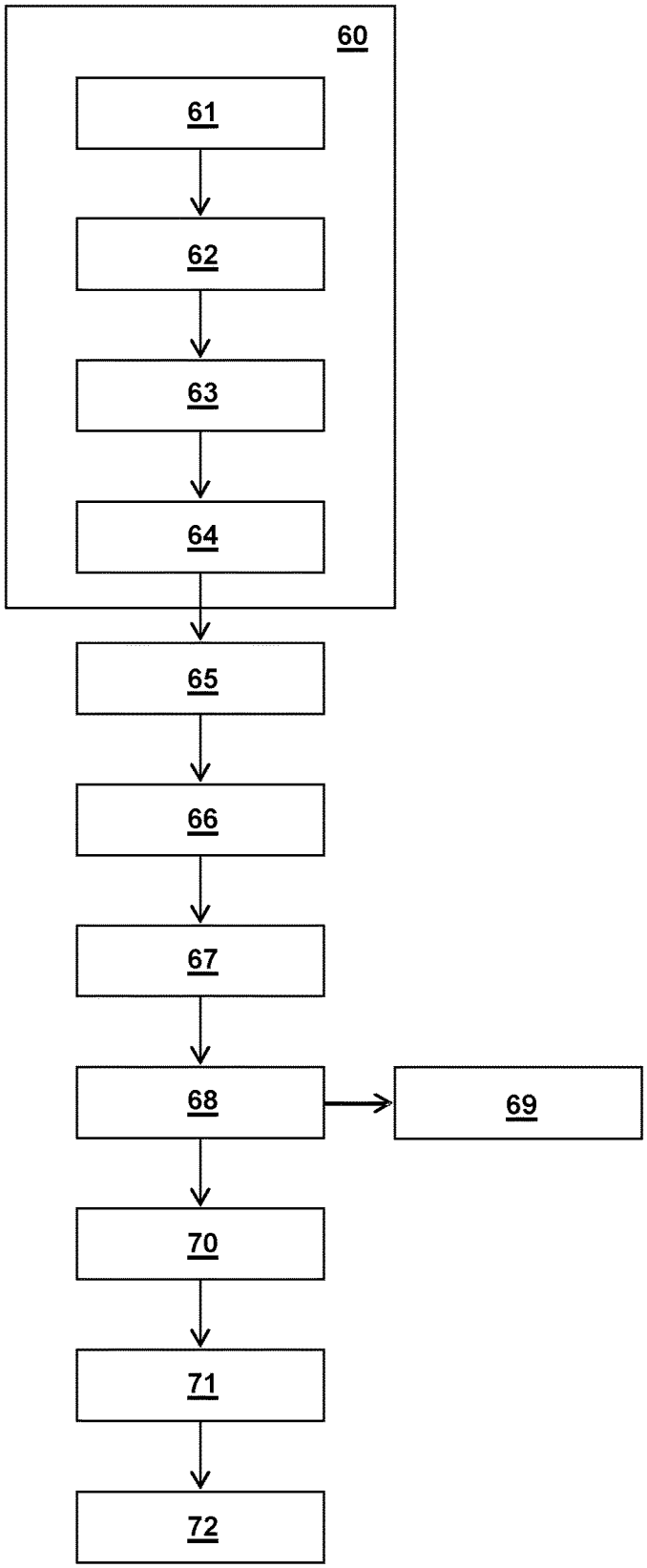
FIG. 10 in an exemplary way shows a method which can be executed by means of the control logic of an electronic control unit of an electronics construction unit 6 of a pliers tool 1.

At least one circuit board 40, 41 comprises an electronic control unit 57, where the two circuit boards 40, 41 can form a control unit 57 together. The control unit 57 comprises control logic which especially may execute part or all of the method steps described in the following and shown in FIG. 10:

In a method step 16, the electronics construction unit 6 is connected by an external device such as a PC, a smartphone or similar, where this connection may be wire-bound or wireless. In case a wireless connection is to be established (e.g. via Bluetooth), in a method step 61 the pushbutton 47 is actuated for a longer time span, especially at least 5 seconds. If by means of this longer actuation of the pushbutton 47 the control unit 57 detects that a connection is to be established, in a method steps 62 the RGB lamp 59 is controlled in a suitable color by the control unit 57 so that it flashes. In this way, the user can recognize by way of the flashing backlight of the lid 30 that the function of establishing the connection is activated. In a method step 63 then the connection routine of the control unit 57 is started and the connection to the external device is established. If a device is found, on this device a prompt appears such as e.g. "Couple pliers tool no.) xx? Yes/no". A connection can only be established when the prompt is acknowledged by the user. A connection once established can be automatically, e.g. after 120 seconds, interrupted if the connection is not used within this time span. If the connection has been established, in a method step 64 the control of the lamp 59 is changed by deactivating it or generating a constant lighting effect, in which way it is a visible for the users that a connection has been established. After the connection has been established in this way, in a method step 64 the electronics construction unit 6 can be programmed or data can be transferred to the electronics construction unit 6. For example, via the connection established a name or a designation of a manufacturer of the pliers tool 1, an owner of the pliers tool or of the company in which it is used or a name of the user or worker may be transmitted. Furthermore it is possible for calibrating factors for sensors employed in the electronics construction unit 6 to be transmitted to the control unit 57 in the method step 65. It is also possible that the operating mode of the pliers tool 1 is individualized in that e.g. colors may be set by the user in which the lamps 58, 59 are to emit light or threshold values for an analysis of the measurement signals recorded by the sensors may be set.

If, however, while establishing the connection is attempted no device for coupling is found within a pre-set time span, especially 60 seconds, establishing the connection is automatically terminated and the RGB lamp 59 is deactivated again. If, however, a coupling to a device is successfully established, the RGB lamp 59 may permanently shine for a pre-set time span, especially 5 seconds, and then be deactivated again.

If the pliers tool 1 has been prepared for use as explained before, its use itself may commence. At first, the pliers tool 1 in a method step 66 is in a rest state so that it is not moved. In the method step 66, the pliers tool 1 is a standby mode in which the electric power consumption of the electronics construction unit 6 is minimized. The electronics construction unit 6, however, monitors whether an acceleration sensor, which may also be integrated into the electronics construction unit 6, detects acceleration, in which way it is determined that the pliers tool 1 has been taken into the hand of a user. In order to achieve this, the control unit 57 preferably compares the signal of the acceleration sensor to a threshold value. If a movement of the pliers tool 1 is detected, the electronics construction unit 6 in a method step 67 switches from a standby mode to a standby ready mode in which an enlarged function pool is guaranteed and there is a higher power consumption than in the standby mode. In the standby ready mode, in a method step 68 it is checked whether there is an operation of the pliers tool 1. This can e.g. be achieved by checking whether the hand levers are contacted or there is a movement of a component of the pliers tool 1 or a force is effective on the hand levers, the drive mechanism or the pliers jaws. During this check and in the standby ready mode, the lamps 58, 59 may still be deactivated and the display 48 may still be deactivated. If during a pre-set time span, e.g. 60 seconds, there is no actuation of the pliers tool 1 in the standby ready mode, in a method step 69 the electronics construction unit 6 can automatically return to the standby mode. If, however, the pliers tool 1 is operated, in a method step 70 the display 48 and at least one lamp 58, 59 are activated. The desired notice can then be generated on the display 48, where it e.g. displays the number of completed working strokes, a charge state of the battery or the accumulator 25 (preferably in percent or by means of a bar), a name or a designation of a manufacturer, owner or user and a possible prompt that service of the pliers tool 1 is necessary since a number of completed working strokes is larger than a threshold value. After a working stroke has been completed, in a method step 71 the result of an analysis e.g. of the pliers force progression may be displayed on the display 48. In a method step 72, the electronics construction unit 6 may automatically return to the standby mode if via the acceleration sensor it is detected that for more than e.g. 5 seconds there has been no movement of the pliers tool 1.

If a preferably white lamp 58 is to be switched on in order to light the environment of the electronics control unit 6, this may be achieved by a short actuation of the pushbutton 47, while another short actuation of the pushbutton 47 leads to the deactivation of the lamp 58 or the lamp 58 is automatically deactivated after a pre-set time span or when it is determined by the acceleration sensor that the pliers tool 1 has been put down. Therefore, the pushbutton 47 is multifunctional in that depending on the mode of actuation, which here is the length of actuation, via the pushbutton establishing the connection can be initiated or the lamp 58 can be activated.

The display especially comprises two or more lines for text which may e.g. each comprise more than 10 characters. The character set may be an 8-bit ASCII character set so that it may contain alphanumeric characters as well as accents and umlauts.

If the control unit 57 recognizes that the charge state of the battery or the accumulator 25 is insufficient, the lamps 58, 59 and/or the display 48 may be automatically dimmed or even deactivated by the control unit 57.

As a sensor for detecting a movement of a construction element of the pliers tool 1, especially the compression lever 20, an IR proximity sensor may be employed which in this case may fulfil two functions. The sensor may detect whether components of the pliers tool 1 are moved, in which way completion of the working stroke can be inferred and therefore operation of the pliers tool one can be inferred. On the other hand, the sensor can be used to count the completed working strokes. When the pliers tool is opened and closed, the counter is increased by 1. When switching from the standby mode to the standby ready mode, the IR proximity sensor is activated.

For the embodiment described, no manual actuation of the electronics construction unit via a switch or pushbutton is necessary before the pliers tool 1 is operated. For the embodiment shown, the compression lever 20 comprises a lug or nose 73, which is moved along the IR proximity sensor so that the IR proximity 70 sensor can detect the relative movement of the lug 73.

In the region of the pliers head 7, an interspace open to the outside is formed between the cover plates 17, 18. This interspace is covered by a cover element 75 at least over a partial circumference of the pliers head 7 and especially in the interior of the electronics construction unit 6 and neighboring to the electronics construction unit 6. The cover element 75 comprises a T-shaped cross-section. The vertical leg of the T is inserted into the interspace between the cover plates 17, 18 and fixed there, which may be achieved by clipping or a friction-locking connection to the cover plates 17, 18 or by fixing to them in another way. The horizontal leg of the T covers the interspace between the cover plates 17, 18 to the outside, where the horizontal leg of the T rest against the front faces of the cover plates 17, 18. Preferably, the cover element 75 is made of plastic. It is possible for the vertical leg of the T to be continuous so that it forms a kind of ridge which enables connection to the cover plates 17, 18. It is, however, also possible for the vertical leg of the T to be only realized in partial circumferential regions of the pliers head 7, in which way then only in these partial circumferential regions the cover element 75 is fixed to the cover plates 17, 18.

Many variations and modifications may be made to the preferred embodiments of the invention without departing substantially from the spirit and principles of the invention. All such modifications and variations are intended to be included herein within the scope of the present invention, as defined by the following claims.

I claim:

1. A manual pliers tool comprising:

a mechanical pliers part and an electronics construction unit that outputs and/or processes a plurality of operating parameters and measurements, the mechanical pliers part comprising:

a) two pivotable hand levers, b) two pliers jaws movable relative to one another, c) a drive mechanism comprising a compression lever coupled to the pliers jaws and to the hand levers, d) a pliers head part comprising a pliers housing positioned over a portion of the hand levers and the pliers jaws, wherein e) the drive mechanism couples the pliers jaws with the hand levers pivoting the hand levers towards each other causes the pliers jaws to be moved towards each other over a working stroke, and the electronics construction unit comprising a connector that extends through or around the pliers head part between the two opposite sides of the pliers head part, wherein the electronics construction unit:

a) is realized separately from the mechanical pliers part, b) is arranged on the pliers head part, c) is fixed to the pliers head part, and d) extends at least on two opposite sides of the pliers head part, wherein the electronics construction unit is positioned so that the pliers head part is at least partially enclosed by the electronics construction unit.

2. The pliers tool according to claim 1, wherein the electronics construction unit further comprises a continuous recess having a cross section with a closed circumference which extends through the electronics construction unit, and wherein the electronics construction unit completely encircles the mechanical pliers part.

3. The pliers tool according to claim 1, wherein the electronics construction unit further comprises one or more of the following:

a) an electronic control unit, b) an input element, c) an output element, d) a display element, e) a lamp, f) an acoustic output element, g) a sensor.

4. The pliers tool according to claim 1, wherein the electronics construction unit further comprises a housing comprising two housing parts that define a continuous recess, and wherein the two housing parts extend around the mechanical pliers part without gaps in the circumferential direction.

5. The pliers tool according to claim 1, wherein the electronics construction unit further comprises a housing comprising a housing part which forms a front face of the electronics construction unit that is facing the pliers jaws.

6. The pliers tool according to claim 1, wherein the electronics construction unit further comprises a housing comprising two housing parts and a further housing part, where when the two housing parts are mounted to the mechanical pliers part the two housing parts extend around the mechanical pliers part without gaps in the circumferential direction, wherein the further housing part forms a front face of the electronics construction unit turned towards the pliers jaws, wherein the further housing part is in form-locking connection with the two housing parts and have a direction of assembly in the direction of a longitudinal axis of the pliers tool, and wherein the two housing parts are in form-locking connection with each other and have a direction of assembly vertically to the longitudinal axis of the pliers tool.

7. The pliers tool according to claim 1, wherein the pliers tool further comprises a pliers head plane and the electronics construction unit further comprises a housing comprising a front face turned towards the hand levers, wherein the front face is V-shaped when viewed from above the pliers head plane, and wherein the hand levers each extend from the housing from one leg of the V-shaped front face.

8. The pliers tool according to claim 1, wherein the pliers tool further comprises at least two circuit boards and a circuit board is arranged on each side of the pliers head part.

9. The pliers tool according to claim 8, wherein the pliers tool further comprises a cable which extends in the circumferential direction around or through the mechanical pliers part and the two circuit boards are connected to each other via the cable.

10. The pliers tool according to claim 1, wherein the electronics construction unit further comprises a housing and a lamp, wherein a portion of the housing of the electronics construction unit is transparent or partially transparent to light, and wherein the lamp is arranged in the interior of the housing and oriented in such a way that light emitted by the lamp impinges onto the transparent or partially transparent portion of the housing.

11. The pliers tool according to claim 1, wherein the pliers tool further comprises a battery or an accumulator and the electronics construction unit is supplied with electric energy via the battery or the accumulator.

12. The pliers tool according to claim 11, wherein the battery or the accumulator is integrated into one of the hand levers.

13. The pliers tool according to claim 12, wherein the one of the hand levers into which the battery or the accumulator is integrated comprises a metallic hand lever bar and a plastic handle and an interspace formed between the metallic hand lever bar and the plastic handle and the battery or the accumulator is arranged in the interspace between the hand lever bar and the handle.

14. The pliers tool according to claim 1, wherein the electronics construction unit further comprises a sensor configured to sense movement of the drive mechanism by sensing movement of a component of the drive mechanism relative to the sensor.

15. The pliers tool according to claim 1, wherein the mechanical pliers part further comprises cover plates, an interspace formed between the cover plates and a cover element, where the cover element is arranged in the region of the pliers head and covers the interspace formed between the cover plates to the outside over at least a partial circumference of the pliers head.

16. The pliers tool according to claim 1, wherein the pliers tool further comprises an electronic control unit and the electronic control unit comprises control logic, where the control logic accomplishes one or more of the following functions:

a) the pliers tool comprises a battery or an accumulator having a charge state and the control logic analyzes the charge state of the battery or the accumulator, b) the pliers tool comprises a sensor which determines a pliers jaw force effective onto the pliers jaws and/or a pliers jaw displacement and the control logic processes or analyzes the pliers jaw force effective onto the pliers jaws and/or the pliers jaw displacement determined by the sensor, c) the control logic determines or analyzes a number of completed working strokes of the pliers tool, d) a threshold value for the number of working strokes to be completed by the pliers tool can be pre-set and the control logic determines or analyzes a number of completed working strokes of the pliers tool and makes a comparison of the number of completed working strokes to the threshold value, e) the control logic makes an assessment of the processing process executed with the pliers tool, f) the control logic stores data, g) the pliers tool comprises a sensor sensing operation of the pliers tool and an acceleration sensor, a first time span can be pre-set and the pliers tool comprises a standby mode and a standby ready mode and in the standby mode the control logic activates the standby ready mode if movement of the pliers tool is detected via the acceleration sensor, where in the standby ready mode the sensor senses operation of the pliers tool, or the control logic activates the standby mode if via the acceleration sensor it is detected that the pliers tool is at rest and remains so for the pre-set first time span, h) the pliers tool comprises a sensor sensing operation of the pliers tool and at least one of a display and a lamp and the control logic activates at least one of the display and the lamp when operation of the pliers tool is detected via the sensor, i) the pliers tool comprises a sensor sensing operation of the pliers tool and an acceleration sensor, a first time span and a second time span can be pre-set, where preferably the first time span is longer than the second time span, and the pliers tool comprises at least one of a display and a lamp and the control logic deactivates at least one of the display and the lamp if it is detected via the sensor that for the pre-set first time span no operation of the pliers tool occurs or for the pre-set second time span there is no movement of the pliers tool as detected by the acceleration sensor, j) the pliers tool comprises a wireless sending and/or receiving device and the control logic operates the wireless sending and/or receiving device, k) the pliers tool comprises at least one lamp and the control logic controls the at least one lamp, l) the pliers tool comprises at least one lamp and a battery or an accumulator having a charge state, a threshold value for the charge state of the battery or the accumulator can be pre-set and the control logic dims the lamp if it is detected that the charge state of the battery or the accumulator falls under the threshold value, m) the pliers tool comprises a pushbutton, a lamp and the means to establish a wireless connection, a first time span and optionally a second time span can be pre-set and the control logic analyzes the signal of the pushbutton in such a way that when the pushbutton is actuated for the first time span the lamp is activated while when the pushbutton is actuated for the second time span the wireless connection is activated, n) the control logic enables configuration of the pliers tool, o) the hand levers comprise a closed end position and the control logic detects when the closed end position of the hand levers is reached, p) the pliers tool comprises a localization function that enables localizing the pliers tool and the control logic controls the localization function, q) the pliers tool comprises an anti-theft protection function and the control logic controls the anti-theft protection function of the pliers tool, r) the pliers tool is equipped with means to provide acoustic output and the control logic controls the acoustic output of the pliers tool, s) the pliers jaws are equipped to enable insertion of a workpiece that is to be processed with the pliers tool, the pliers tool comprises an electronic insertion control for controlling insertion of the workpiece into the pliers jaws and the control logic executes the electronic insertion control, t) the pliers tool comprises a display on which a notice can be shown, where one or more of the following values can be derived by the control logic:

a name or an identification of a manufacturer, an owner or a user of the pliers tool, where the pliers tool comprises a battery or an accumulator, a charge state of the battery or the accumulator, where the pliers tool comprises a sensor to measure a pliers jaw force or a pliers jaw displacement or to monitor a progression of the pliers jaw force or the pliers jaw displacement, the measured pliers jaw force or the measured pliers jaw displacement or the progression of the pliers jaw force or pliers jaw displacement, where the control logic determines or analyzes a number of completed working strokes of the pliers tool, a number of completed working strokes, where the control logic makes an assessment of a processing process executed with the pliers tool, a result of that assessment, where a threshold value for the number of working strokes to be completed by the pliers tool can be pre-set and the control logic makes a comparison of the number of completed working strokes to the threshold value, the result of that comparison, an indication that maintenance of the pliers tool is necessary and the control logic generates the notice, where the notice is or correlates with one or more of the values derived.

17. A manual pliers tool comprising:

a mechanical pliers part comprising:

a) two pivotable hand levers, b) two pliers jaws movable relative to one another, c) a drive mechanism comprising a compression lever coupled to the pliers jaws and to the hand levers, d) a pliers head part comprising a pliers housing positioned over a portion of the hand levers and the pliers jaws, wherein e) the drive mechanism couples the pliers jaws with the hand levers pivoting the hand levers towards each other causes the pliers jaws to be moved towards each other over a working stroke; and an electronics construction unit that outputs a plurality of operating parameters and measurements, the electronics construction unit comprising:

at least two circuit boards, wherein a circuit board is arranged on each side of the pliers head part; and a connector that extends through or around the pliers head part between the two opposite sides of the pliers head part, wherein the electronics construction unit is:

a) realized separately from the mechanical pliers part, b) arranged in or on the pliers head part, c) fixed to the pliers head part, and d) extends at least on two opposite sides of the pliers head part, wherein the electronics construction unit is positioned so that the pliers head part is at least partially enclosed by the electronics construction unit.

* * * * *